US005139409A

United States Patent [19]

Bevan et al.

[11] Patent Number: 5,139,409

[45] Date of Patent: Aug. 18, 1992

[54] APPARATUS FOR USE IN MOLDING

[75] Inventors: Christopher G. Bevan, Corby; Douglas Hacking, Melton Mowbray, both of England

[73] Assignee: Dryflow Limited, Corby, United Kingdom

[21] Appl. No.: 515,230

[22] Filed: Apr. 27, 1990

[30] Foreign Application Priority Data

May 5, 1989 [GB] United Kingdom ..... 8910299

[51] Int. Cl.[5] ..... B29C 33/76

[52] U.S. Cl. ..... 425/417; 264/314; 425/427; 425/468; 425/DIG. 14

[58] Field of Search ..... 425/456, 417, 424, 432, 425/468, 522, DIG. 14, 425–427; 264/71, 314, 128, 133, 69, 333

[56] References Cited

U.S. PATENT DOCUMENTS

| | | | |
|---|---|---|---|
| 2,052,818 | 9/1936 | Freyssinet et al. | 264/314 X |
| 2,311,358 | 2/1943 | Baily | 264/71 |
| 3,651,180 | 3/1972 | Glueckert | 425/DIG. 14 |
| 3,862,736 | 1/1975 | Herro | 425/DIG. 14 |
| 4,698,011 | 10/1987 | Lamalle et al. | 425/DIG. 14 |
| 4,812,273 | 3/1989 | Bevan | 264/314 X |

FOREIGN PATENT DOCUMENTS 2183200 6/1987 United Kingdom .

*Primary Examiner*—Richard L. Chiesa
*Attorney, Agent, or Firm*—Fisher, Christen & Sabol

[57] ABSTRACT

A reblow former for use in the manufacture of moulded construction products from dry particulate materials is proposed which includes an elongate body part (11) and an inflatable elastomeric sleeve (14) disposed about the body part, the body part having ribs (12) thereon to provide an indented transverse profile and the sleeve (14) having a transverse perimeter length which corresponds to that of the body part (11) and lying in intimate surface contact with the body part (11) in the non-inflated condition thereof. The transvere perimeter length of the sleeve (14) in the unstretched state thereof approximates to the transverse perimeter length of a core void (15) into which the reblow former is inserted such that, on inflation, the sleeve (14) is brought into contact with the core void surface of the core with not material stretching of the material of the sleeve.

6 Claims, 2 Drawing Sheets

APPARATUS FOR USE IN MOLDING

FIELD OF THE INVENTION

The invention concerns apparatus for use in moulding, and has more particular reference to an expandable former for applying pressure to material in a mould.

BACKGROUND OF THE INVENTION

In our copending United Kingdom Patent Application No. 8626685 (UK-A-2183200) we have described a method for producing hollow cored construction products from dry particulate material wherein there is proposed an additional step in the process involving the application of pressure to damp, uncured material while it is in the mould, the pressure being applied from within the material by an expandable sleeve positioned within each core void.

A typical construction product made by the method comprises a building panel having a plurality of parallel core voids extending the full vertical extent thereof, such voids being formed by expandable core void formers positioned in the mould. The mould is filled, whilst being vibrated, with an appropriate dry powder mix, optimally containing fibres, such vibration imparting an initial or pre-compaction to the mix. After such pre-compaction, the core void formers are expanded to apply pressure to and thereby further compact the mix and are then retracted to their pre-expanded state to allow them to be withdrawn, leaving corresponding core voids in the compacted dry powder mix. The powder surfaces of the voids are then lightly sprayed with setting liquid and, after sufficient liquid has been absorbed, a further set of expandable core void formers (called hereinafter "reblow formers") are inserted into the voids and expanded in order to press the dampened material firmly to the mould sides in order to ensure a good quality surface finish to the final moulded product.

SUMMARY OF THE INVENTION

The present invention relates to this final stage and concerns the design of the aforesaid reblow formers.

More detailed investigations into the design of reblow formers have shown there to be two main requirements governing the dimensions of the reblow formers:

Firstly, the reblow former must be of reduced cross-sectional dimensions relative to the dimensions of the core void, to provide sufficient clearance between the reblow former and the sides of the core void for easy insertion of the former without damaging the still fragile surface of the dampened powder.

Secondly,—and in direction contradistinction to the first requirement—the aforesaid clearance should be minimal in order to minimise the extent to which the sleeves need to expand in order to make contact with the dampened powder, it having been found that such expansion, and particularly any stretching action of the sleeve can cause cracks in the dampened powder which are apparent in the finished product. Such cracks can occur particularly in situations where the powder is dampened only just sufficiently to ensure there are no dry spots, since, in this situation, the dampened powder flows very little under pressure, and the tensile stress caused by the stretching action of the sleeve of the reblow former simply ruptures the dampened powder.

The object of the present invention is to provide a reblow former which avoids the formation of such "reblow cracks".

According to one aspect of the present invention, there is proposed an inflatable former for location in a core void in a pre-compacted, dampened powder mix existing in a mould for applying localised pressure to the said mix from within the core void, the said former comprising an elongate body part and an inflatable sleeve disposed about the said body part and attached thereto, the sleeve being adapted and arranged such that, on application of air or fluid pressure, the sleeve expands laterally away from the body part to make contact with the surface of the core void, characterised in that the perimeter length of the transverse section of the sleeve when in the unexpanded state is the same or substantially the same as the perimeter of the core void against which it will make contact, so that when expanded into contact with the core void the sleeve does not stretch or stretches to an extent insufficient to cause visible cracks in the dampened powder, and in that the sleeve, when retracted onto the body part, assumes a more complex shape wherein the overall cross-sectional dimensions thereof are sufficient to provide a clearance with respect to the core void.

According to a preferred feature of the invention, the body part includes a core having longitudinal ribs or indentations extending outwardly therefrom to provide the required cross-sectional perimeter length, the sleeve being adapted to be collapsed onto the body part by reducing the pressure within the sleeve so that effectively the sleeve takes up the transverse profile of the ribbed or indented body part.

According to another aspect of the present invention there is proposed an inflatable reblow former for location in a core void in a dampened, compacted powder mix existing in a mould for the application of pressure to the mix from within the core void, said former comprising an elongate body part and an inflatable sleeve member mounted on said body part and adapted, upon application of pressure air or fluid thereto, to expand outwardly of the body part characterised in that the body part includes a core having ribs or indentations longitudinally thereof and has a ribbed or indented transverse profile, thereby to define at least one free space extending longitudinally of the body part to receive material of the sleeve in the collapsed condition thereof.

Retraction of material of the sleeve into the said at least one free space may be effected by application of a reduced pressure to the sleeve, although preferably the sleeve, which sleeve is of essentially constant wall thickness, will be moulded to conform to the transverse profile of the body part.

According to a further preferred feature, the body part is of polygonal transverse cross-section, the body part comprising a core and a rib provided along each longitudinal corner thereof, the ribs being symmetrically divergent outwardly from the core of the body part.

According to a still further preferred feature, the sleeve is attached to the ribbed body part by fixing clamps of approximately trapezoidal shape, the said clamps firmly pressing the sleeve material against the core of the body part and against the ribs. Preferably, the ribs are cut away in the immediate vicinity of the fixing clamps, so that the sleeve is pinched against itself by the fixing clips rather than against the ribs.

In a further preferred feature, the cross-sectional dimensions of the core of the body part are reduced in the immediate vicinity of the fixing clamps so that the said clips do not protrude beyond the overall cross-sectional dimensions of the ribbed body part and the retracted sleeve. Preferably, the cross-sectional dimensions of the core of the body part in the immediate vicinity of the fixing clamps is increasingly reduced towards the tip of the body part so that, when the clamps are fixed to the body part, the tip region is effectively tapered to provide easy entry into the core void in the dampened powder.

The invention also includes a method wherein there is proposed, in the method of manufacturing cored construction products from dry particulate material, which may include fibres and comprising the steps of providing a mould having at least one core former therein, filling the mould with an approximate mix of the said materials, effecting compaction of the said materials, removing the said at least one core former to form a core void and applying a sufficient quantity of setting liquid to the compacted said material existing in the mould to give full impregnation thereof by capillary action, and subsequently introducing a reblow former into the core void, the said reblow former comprising an elongate body part having a sleeve provided outwardly thereof and in sealed relationship thereto, and bringing the sleeve into pressure contact with the walls of the core void, the further step of arranging that the transverse peripheral dimension of the sleeve in the relaxed condition of the material thereof approximates to the corresponding dimension of the core void such that in said pressure contact condition the material of said sleeve is in a substantially unstretched state.

BRIEF DESCRIPTION OF DRAWINGS

The invention will now be described further by way of example only, with reference to the accompanying drawings in which.

DETAILED DESCRIPTION OF THE PREFERRED EMBODIMENT

Figure 1:
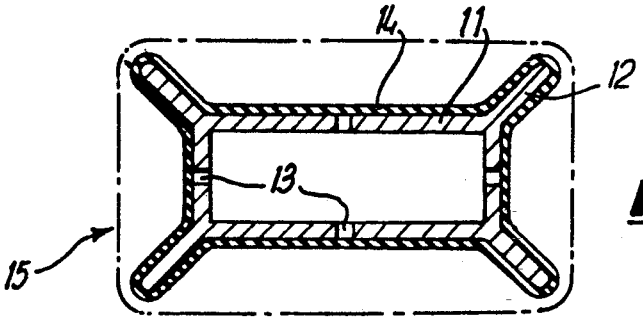
FIG. 1 is a typical transverse section of the reblow former with the sleeve in the fully retracted position for entry into the core void, the core void being shown as a dotted line.
Figure 2:
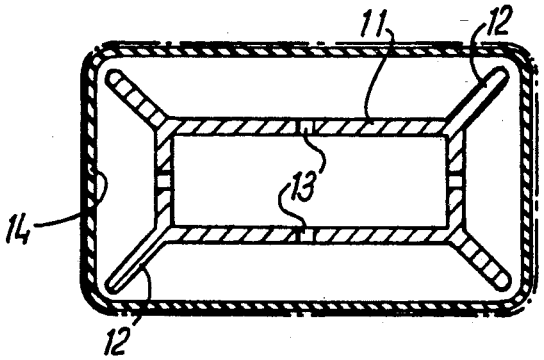
FIG. 2 is the same transverse section as that shown in FIG. 1 but with the sleeve fully expanded against the sides of the core void.

Referring to the drawings, and particularly to FIGS. 1 to 5 thereof, the reblow former assembly shown comprises a main body part 11 having ribs 12 and a multiplicity of small diameter holes 13 through which the air within the main body part 11 can be extracted in order to pull sleeve 14 firmly onto the body part as shown in FIG. 1 and thereby provide sufficient clearance for easy entry into the core void 15. After complete entry into the core void, compressed air is blown into the body part to expand the sleeve 14 onto the surface of the core void as shown in FIG. 2.

The transverse perimeter length or circumference of sleeve 14, when the material is in the unstretched state, is the same or similar to the perimeter length of the core void 15. The transverse dimensions of the main body part 11 and ribs 12 provide a similar perimeter length for the complete body part as for the unstretched sleeve, so that, when a partial vacuum is applied, the sleeve lies closely against the body part without wrinkles or tucks the presence of which might restrict entry into the core void. Generally, the perimeter length of the body part is made slightly less than that of the unstretched sleeve to ensure an unwrinkled fit when the vacuum is applied.

The sleeve 14 is generally between 1.5 and 2.5 mm thick, and is made of elastomeric material such as synthetic or natural rubber. Alternatively, the sleeve may comprise a fabric reinforced or otherwise made substantially unstretchable, since, with correct dimensioning, the sleeve is not required to stretch in order to make full contact with the entire perimeter of the core void. In practice, however, it is difficult to ensure sufficiently accurate dimensioning to use a completely unstretchable sleeve, and an elastomeric sleeve provides full contact even if the sleeve perimeter is slightly smaller than the corresponding void perimeter. This implies some stretching of the sleeve to make such complete contact, but there is generally sufficient tolerance in the dampened powder mix to allow at least some stretching of the sleeve without giving rise to cracks which are visible in the finished product.

Figure 3:
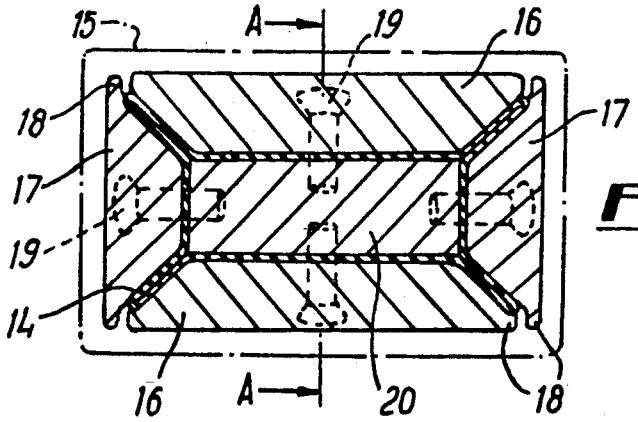
FIG. 3 is a typical transverse section at the end of the reblow former, showing the clamps for fixing the sleeve to the body part.

A further advantage of using elastomeric sleeves is that when such materials are clamped, as shown in FIG. 3, they provide sufficient resilience to effect an air tight seal and can more easily accommodate the transition from the shape shown in FIG. 1 to the shape in FIG. 3 without local rucking. In accordance with FIG. 4, the ribs 12 are cut away to allow the sleeve to be clamped against itself at the corners, as in FIG. 3, by clamps 16 and 17, such clamps serving also to clamp the elastomer against the central core 20 engaged with the end of the body part 11. For elastomeric sleeves in particular, the clamps have small nibs 18 at the corners to prevent the elastomer from extruding out at the corners, which also helps to provide the all-round positive pressure to the elastomer needed to prevent air leakage when screws 19 are tightened.

To avoid local rucking of the sleeve and difficulties when clamping the sleeve, clamps 16 and 17 are dimensioned so that the perimeter length of the folded sleeve as shown in FIG. 3 is the same or similar to its natural perimeter length in the unstretched state. In order to accommodate this perimeter length within the overall dimensions required for easy entry of the clamped assembly onto the core void, it is generally necessary for the cross-sectional dimensions of central core 20 to the body part to be less than the dimensions of the main body part 11. This reduction in cross-section can conveniently be provided by cutting back the main body part in the vicinity of the clamps, as shown in FIG. 4.

Figure 4:
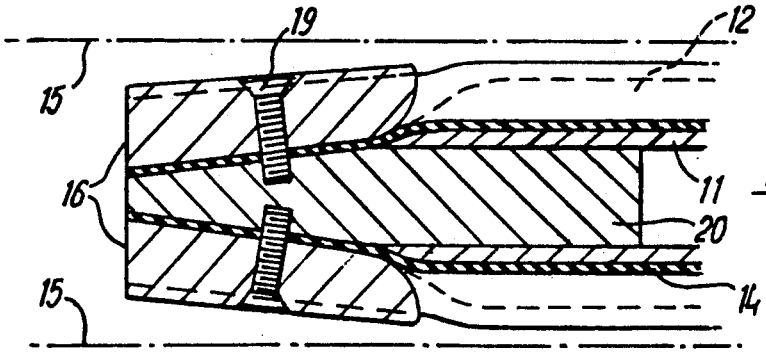
FIG. 4 is a part longitudinal section, on line A—A of FIG. 3, through the end of the reblow former, the sleeve being shown in its retracted state and illustrating the tapered profile of the fixing clamps to facilitate easy entry into the core void.

In order to provide additional tolerance when the reblow former first enters the core void, central core 20 and clamps 16 and 17 may be tapered, as shown in FIG. 4. The edges of the clamps should also be significantly rounded whenever they might otherwise damage the sleeve, particularly when the sleeve is in its fully expanded position as shown in FIG. 5.

Figure 5:
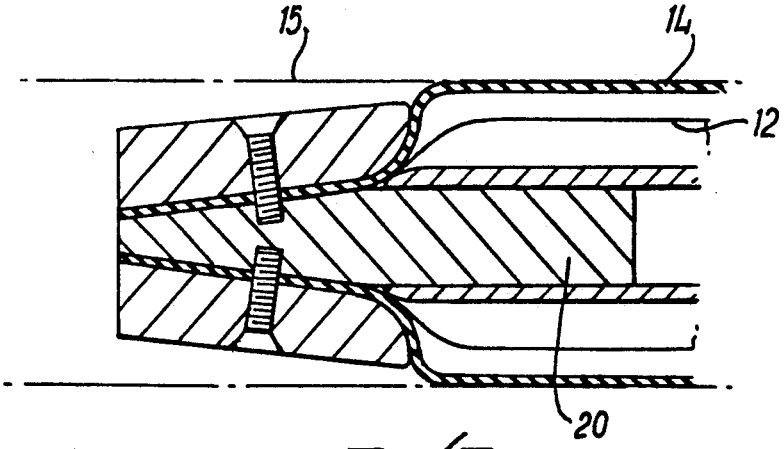
FIG. 5 is a longitudinal section corresponding to FIG. 4 but with the sleeve in its expanded state.

The opposite end of the reblow former to that shown in FIGS. 4 and 5 may be designed along similar lines to those described earlier, except that clamps 16 and 17 and central core 20 need not be tapered. The extra thickness of the central core resulting from dispensing with such tapering usefully provides the extra room required at this end for a hole along the axis of the plug to provide access to the compressed air and vacuum needed to actuate the sleeve. The core can also be extended outwardly from the main body part 11 along the longitudinal axis of the reblow former as far as is needed to provide attachment points for raising and lowering the former relative to the core void. Such details are all within normal engineering practice.

The reblow former described earlier would typically fit into a core void measuring 40 mm×65 mm in transverse cross-sections, but the same design principles would apply to other dimensions. Typical length of a reblow former depends on the product being made and for building panels would be typically around 2.6 m. For elastomeric sleeves without fabric reinforcement, it is usually necessary that the reblow former length fits within the mould containing the dampened powder, in order to ensure that the sleeve is fully supported by the mould when pressurised to its fully expanded state.

The design principles described earlier apply equally to non-rectangular core voids, such as those of circular or oval cross-sectional shape. The number of ribs can be more or less than the four provided in the embodiment described earlier, and the shape of the main body part 11 and ribs 12 do not have to be generated from straight lines as shown in the example, although this is preferable for reasons of manufacturing economy.

Figure 6:
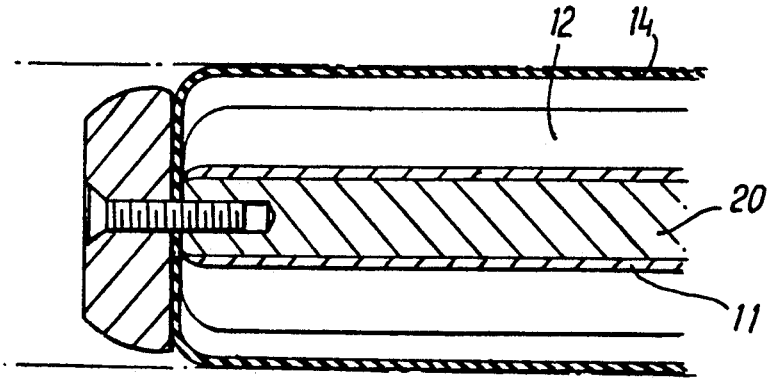
FIG. 6 is a view corresponding to FIG. 5, and illustrates an alternative method of fixing the sleeve at the end of the reblow former.
Figure 7:
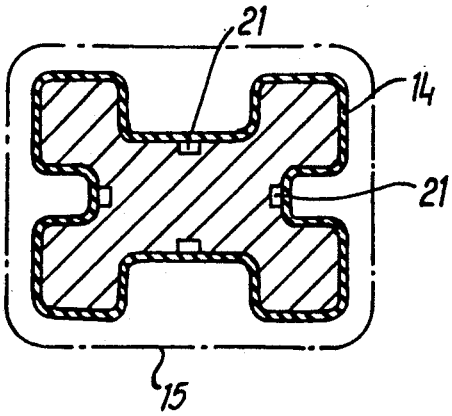
FIG. 7 is a transverse section through the arrangement shown in FIG. 6, the sleeve being in the retracted state, and, furthermore, illustrates an alternative form of ribbing.

It is also not essential to clamp the ends of the sleeve in the manner described, although this is convenient as it enables extruded materials to be used for the sleeves without special moulded ends. When special moulded ends are used for the sleeves, the clamping methods at the ends of the reblow former can be simplified, as shown in FIG. 6. In these circumstances the ribs do not have to relate so directly to the clamping system as shown in FIGS. 1 to 5, and alternative shapes such as that shown in FIG. 7 are possible. In the example in FIG. 7 the air access is via grooves 21 in the body part rather than via a central core hole and perforated walls.

It should also be noted that if moulded rubber is being used for the sleeve, it is practical to mould the rubber to conform to the cross-sectional profile as shown in FIG. 7. In such cases it may not be necessary to apply a vacuum to ensure that there is sufficient clearance for the reblow former to enter the core void. Where vacuum is applied as described for FIGS. 1 to 5, the elastomeric sleeve can be in a simple tubular form, as once vacuum is applied the sleeve readily takes up whatever shape is defined by the internal body part.

Other alternatives will readily present themselves to one skilled in the art, and the invention is not limited to the precise details described and illustrated herein.

Furthermore, whilst the invention is disclosed in the context of core voids existing wholly within the body of the construction panel, it is to be understood that an analogous arrangement may be used in the context of core voids provided at a face of the compacted material and between such material and an opposing mould surface.

We claim:

1. An inflatable reblow former for location in a core void in a dampened, compacted powder mix existing in a mould for the application of pressure to the mix from within the core void, said former comprising an elongate body part and an inflatable sleeve substantially coextensive with the body part in the axial direction thereof and mounted on said body part and movable laterally outwardly thereof on application of pressurized air or fluid thereto, the sleeve being of an elastomeric material and the body part including a core having ribs or indentations longitudinally thereof which provides at least one free space extending longitudinally of the body part to receive material of the sleeve in the collapsed condition thereof;

wherein said body part is of polygonal transverse cross-section, said body part comprising a core and a rib provided along each longitudinal corner thereof, the ribs being symmetrically divergent outwardly from the core of the body part;

and wherein the sleeve is attached to the ribbed body part by fixing clamps of approximately trapezoidal shape, the said clamps firmly pressing the sleeve material against the core of the body and against the ribs.

2. An inflatable former as claimed in claim 1, wherein the transverse cross-sectional form of the sleeve in the collapsed condition thereof conforms to the transverse profile of the body part.

3. An inflatable former as claimed in claim 1, wherein the sleeve is of essentially constant wall thickness.

4. An inflatable former as claimed in claim 1, wherein the ribs are cut away in the immediate vicinity of the fixing clamps, so that the sleeve is pinched against itself by the fixing clamps rather than against the ribs.

5. An inflatable former as claimed in claim 1, wherein the cross-sectional dimensions of the core of the body part are reduced in the immediate vicinity of the fixing clamps so that the said clamps do not protrude beyond the overall cross-sectional dimensions of the ribbed body part and the retracted sleeve.

6. An inflatable former as claimed in claim 1, wherein the cross-sectional dimensions of the core of the body part in the immediate vicinity of the fixing clamps is increasingly reduced towards the tip of the body part so that, when the clamps are fixed to the body part, the tip region is effectively tapered.

* * * * *